US006196850B1

(12) United States Patent
Dietz et al.

(10) Patent No.: US 6,196,850 B1
(45) Date of Patent: Mar. 6, 2001

(54) ROTATABLE DOCKING STATION FOR AN ELECTRONIC DEVICE

(75) Inventors: Timothy Alan Dietz; Carol Angela Logan, both of Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/501,935

(22) Filed: Feb. 10, 2000

(51) Int. Cl.[7] ..... H01R 39/00

(52) U.S. Cl. ..... 439/17

(58) Field of Search ..... 439/17–22, 24, 439/27, 164; 361/785, 744, 735

(56) References Cited

U.S. PATENT DOCUMENTS 3,479,632 * 11/1969 Galles ..... 439/21
4,475,779 * 10/1984 Fohl ..... 339/5 M
5,009,604 * 4/1991 Plocek et al. ..... 439/15
5,851,120 * 12/1998 Sobhani ..... 439/17

* cited by examiner

*Primary Examiner*—Neil Abrams
*Assistant Examiner*—Javaid Nasri
(74) *Attorney, Agent, or Firm*—Jospeh P. Lally; Mark E. McBurney

(57) ABSTRACT

The problems identified above are in large part addressed by an docking assembly including an electronic device, a base piece, and a rotating piece. The base piece is electrically connected to at least one peripheral device. The rotating piece is intermediate between the electronic device and the base piece. The rotating piece enables rotational movement of the electronic device with respect to the base piece while maintaining electrical contact between one or more signal carriers of the electronic device and corresponding signal carriers of one or more peripheral devices. The assembly may include a set of conductive bearings at an upper surface of the base piece. In this embodiment, each conductive bearing is in electrical contact with a corresponding signal carrier in the base piece. The rotating piece may include an annular conductive element at a lower surface of the rotating piece. The conductive element is in contact with a corresponding bearing element. The base piece may include a set of conductive axial elements that provide a connection between the conductive bearing at a first end and a corresponding signal carrier in the base piece at a second end. The base piece signal carrier may be connected to a corresponding axial element through an intermediate base piece conductive element. The conductive bearing may comprise a material selected from the metals including aluminum, copper, and gold. In one embodiment, a lower surface of the rotating piece includes at least one annular tongue protrusion and an upper surface of the base piece includes at least one annular groove corresponding to each of the tongue protrusions. The tongue protrusions of the rotating piece are seated within corresponding grooves of the base piece thereby preventing translational movement between the rotating piece and the base piece when the rotating piece is rotated with respect to the base piece.

17 Claims, 3 Drawing Sheets

ROTATABLE DOCKING STATION FOR AN ELECTRONIC DEVICE

BACKGROUND

1. Field of the Present Invention

The present invention generally relates to the field of electro-mechanical interfaces and more particularly to the design of a mechanism suitable for enabling rotational movement of an electronic device relative a base piece connecting the electronic device with one or more external peripheral devices.

2. History of Related Art

Laptop style personal computers (laptops) are well known in the field of microprocessor based computer systems. Laptops provide a portable data processing system in a relatively small and typically foldable package that is suitable for transporting from place to place. Typically, such systems are capable of operating on batteries for an extended period such that the system can be operated when the user is away from a source of AC power, such as when the user is in an airplane or automobile. Typically, smaller and lighter laptop systems are preferred to larger and heavier systems. Unfortunately, some features of laptops systems that would otherwise be larger for ease of use, such as keyboards and display screens, are intentionally reduced in size to achieve the desired laptop footprint. When a laptop user has access to a source of AC power, such as when the user is in his or her home or office, it is frequently desirable to connect standard sized peripheral devices to the laptop system to facilitate system use. Docking stations are typically employed to achieve this connection between externally supplied peripheral components and a laptop personal computer. A docking station includes facilities for connecting various peripheral devices to a laptop system. Unfortunately, when the laptop is connected to the docking station, the user is typically unable to move the laptop system except within a very limited range. Under some conditions, such as when multiple people are working on a project, it would be desirable to be able to rotate the laptop system even when the laptop system is connected to its docking station to enable multiple users, for example, to view the display screen of the laptop system without difficulty. Therefore it would be desirable to implement a docking station or other suitable device that would enable the free rotation of an electronic device such as a laptop personal computer when the electronic device is connected the docking station.

SUMMARY OF THE INVENTION

The problems identified above are in large part addressed by a docking assembly including an electronic device, a base piece, and a rotating piece. The base piece is electrically connected to at least one peripheral device. The rotating piece is intermediate between the electronic device and the base piece. The rotating piece enables rotational movement of the electronic device with respect to the base piece while maintaining electrical contact between one or more signal carriers of the electronic device and corresponding signal carriers of one or more peripheral devices. The assembly may include a set of conductive bearings at an upper surface of the base piece. In this embodiment, each conductive bearing is in electrical contact with a corresponding signal carrier in the base piece. The rotating piece may include an annular conductive element at a lower surface of the rotating piece. The conductive element is in contact with a corresponding bearing element. The base piece may include a set of conductive axial elements that provide a connection between the conductive bearing at a first end and a corresponding signal carrier in the base piece at a second end. The base piece signal carrier may be connected to a corresponding axial element through an intermediate base piece conductive element. The conductive bearing may comprise a material selected from the metals including aluminum, copper, and gold. In one embodiment, a lower surface of the rotating piece includes at least one annular tongue protrusion and an upper surface of the base piece includes at least one annular groove corresponding to each of the tongue protrusions. The tongue protrusions of the rotating piece are seated within corresponding grooves of the base piece thereby preventing translational movement between the rotating piece and the base piece when the rotating piece is rotated with respect to the base piece.

BRIEF DESCRIPTION OF THE DRAWINGS

Other objects and advantages of the invention will become apparent upon reading the following detailed description and upon reference to the accompanying drawings in which.

Figure 1:
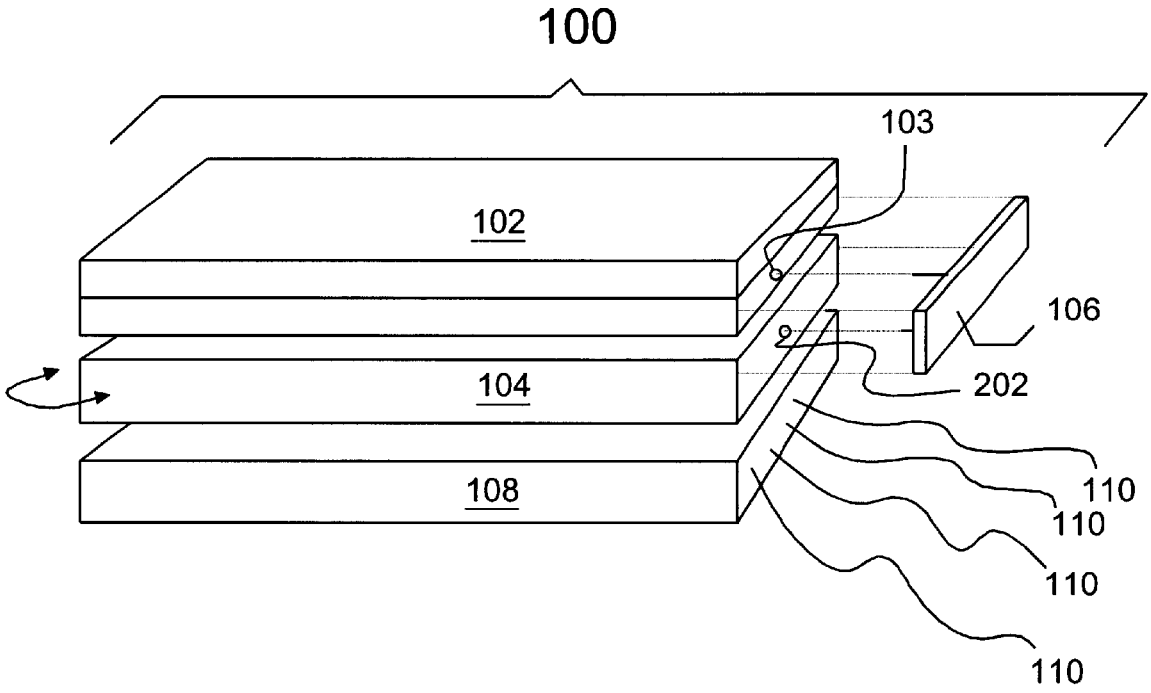
FIG. 1 illustrates an assembly including an electronic device and a rotating docking station according to one embodiment of the invention.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE DRAWINGS

Turning now to the drawings, FIG. 1 depicts an assembly 100 suitable for enabling free rotation of an electronic device that is electrically connected to one or more fixed position external devices. In the depicted embodiment, the assembly 100 includes an electronic device 102, a base piece 108, and a rotating piece 104. Base piece 108 is suitable for being electrically connected to and for receiving a signal carrier from at least one external peripheral device. Rotating piece 104 is intermediate between the electronic device 102 and the base piece 108. Rotating piece 104 enables rotational movement of electronic device 102 with respect to base piece 108 while maintaining electrical contact between at least one signal carrier 103 of the electronic device and a corresponding signal carrier of at least one peripheral device. Electronic device 102 may comprise a data processing system such as a laptop personal computer as described in greater detail below. Electrical signals from electronic device 102 may be transmitted to rotating piece 104 via a connection block 106 or other suitable structure for coupling electrical signals.

Preferably, rotating piece 104 serves as a dock that receives electronic device 102. Accordingly, an upper surface of rotating piece 104 may be suitably sized and configured to provide mechanical support for electronic device 102. Rotating piece 104 is also suitable for receiving at least one signal carrier from electronic device 102 through means such as connector 106. When electronic device 102 is seated in rotating piece 104, electronic device 102 and rotating piece 104 are physically connected such that the rotational and translational movement of electronic device 102 and rotating piece 104 are substantially the same.

Rotating piece 104 is seated on a base piece 108 of assembly 100. Base piece 108 is configured to receive wires or cables (signal carriers) 110 from one or more external peripheral devices to which it is desirable to connect electronic device 102. In an embodiment in which electronic device 102 comprises a laptop personal computer, for example, base piece 108 may include signal carriers for connecting base piece 108 to a keyboard, monitor, printer, pointing device, and to other suitable peripherals. Typically, one or more of the peripheral devices connected to base piece 108 via cables 110 is a fixed position peripheral that is inconvenient to move from location to location. Accordingly, it is preferable if base piece 108 is moved or repositioned relatively infrequently.

To accommodate rotational movement of electronic device 102 without requiring rotation of base piece 108 or movement of the peripheral devices connected to base piece 108, the depicted embodiment of assembly 100 incorporates an electromechanical interface 201 between rotating piece 104 and base piece 108. The interface maintains electrical contact between corresponding conductive elements or signal carriers of the respective pieces while permitting rotating piece 104 to rotate relative to base piece 108.

Figure 2A:
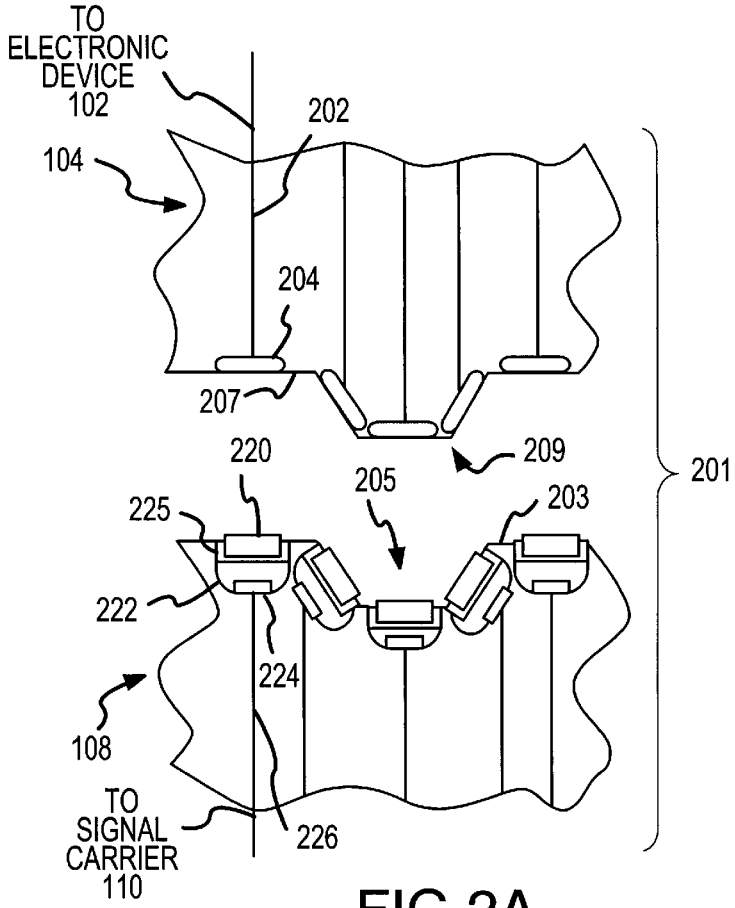
FIG. 2A is a partial cross-sectional view of an electro-mechanical interface implemented according to one embodiment of the invention.
Figure 2B:
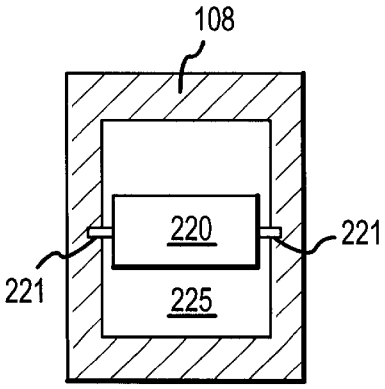
FIGS. 2B, 2C, and 2D are top, front, and orthogonal views respectively of the interface of FIG. 2A.
Figure 2C:
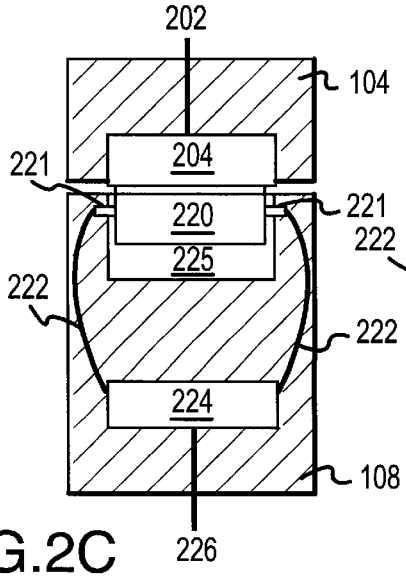
Figure 2D:
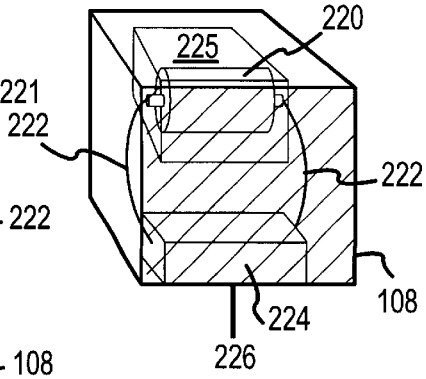

Referring to FIGS. 2A, 2B, 2C and 2D, various views illustrating interface 201 according to one embodiment of the invention are presented. In FIG. 2A, a partial cross-sectional view of one embodiment of the interface between rotating piece 104 and base piece 108 is illustrated. In the depicted embodiment, rotational interface 201 includes an upper surface 203 of base piece 108, a lower surface 207 of rotating piece 104, and a set of rotatable electrically conductive bearings 220*a*, 220*b*, 220*c*, etc. (generically or collectively referred to herein as conductive bearing(s) 220) at an upper surface 203 of base piece 108. Each conductive bearing 220 corresponds to a signal carrier of electronic device 102 and is in electrical contact with a corresponding signal carrier 226 of base piece 108. In the depicted embodiment, each bearing is constructed of electrically conductive material in a cylindrical shape. An axial hole through the center of the cylinder allows an axial shaft 221 comprised of a strong, electrically conductive material to pass through, forming the axis of rotation for the bearing 220. An appropriate, electrically conductive lubricant may be introduced between the shaft 221 and cylinder if needed. Each bearing 220 is mounted in a recess 225 within the base piece 108 to a depth less than the radius of the bearing 220 so that a small amount of clearance is achieved between the upper surface 203 of base piece 108 and the lower surface 207 of rotating piece 104. The top, front cutaway and orthogonal views of FIGS. 2B, 2C, and 2D show the relative positionings of this embodiment,. Lead wires 222 connect conductive element 224 to the axial shaft 221. Each conductive element 224 may comprise an annular strip of copper, aluminum, gold or other suitable electrically conductive material. In this embodiment, a set of conductive elements 224 form a set of concentric, conductive circles within base piece 108 that allows lead 222 to be attached to bearing 220 at multiple points with only one connection from a corresponding signal carrier 226. Each conductive element 224 is insulated from adjacent elements and is connected to a single corresponding base piece signal carrier 226. Each signal carrier 226 may be connected to one of the wires within a cable 110 that connects base piece 108 to one or more peripheral devices or a power source.

Rotating piece 104, according to the embodiment of rotational interface 201 depicted in FIG. 2*a*, includes a set of conductive elements 204 at a lower surface 207 of rotating piece 104. In one embodiment, each conductive element 204 is an annular strip of a conductive material such as copper, aluminum, or gold. Each conductive element 204 is positioned such that it contacts a corresponding conductive bearing 220 when rotating piece 104 is properly positioned on base piece 108. In one embodiment, each annular conductive element 204 contacts multiple conductive bearings 220 to provide proper mechanical support for rotating piece 104. In one embodiment, for example, each conductive element 204 is in contact with (is supported by) three conductive bearings 220 defining a plane. Each conductive contact element 204 is connected to a rotating piece signal carrier or wire 202 that connects the corresponding contact element 204 with a signal of connector 106. In this manner, each conductive contact element 204 is electrically connected through connector 106 with a corresponding signal carrier of electronic device 102.

Thus, the design of rotating piece 104, rotational interface 201, and base piece 108 enable rotating piece 104 to rotate with respect to base piece 108 while simultaneously maintaining an electrical contact between a set of wires 202 in rotating piece 104 and a corresponding set of wires 226 in base piece 108. The depicted embodiment of rotational interface 201 employs a circular tongue and groove design to further facilitate rotational movement of rotating piece 104 with respect to base piece 108 and to decrease the likelihood of misalignment between the corresponding pieces of assembly 100. More specifically, the depicted embodiment of upper surface 203 of base piece 108 includes a circular depression or groove 205 while the lower surface 207 of rotating piece includes a circular tongue protrusion 209. When rotating piece 104 is properly positioned over base piece 108, each tongue 209 of rotating piece 104 will be seated within its corresponding groove 205 of base piece 108 to prevent translational movement of base piece 108 with respect to rotating piece 108 while facilitating rotational movement. In the preferred embodiment, rotating piece 104 may be rotated a full 360° with respect to base piece 108.

Figure 3:
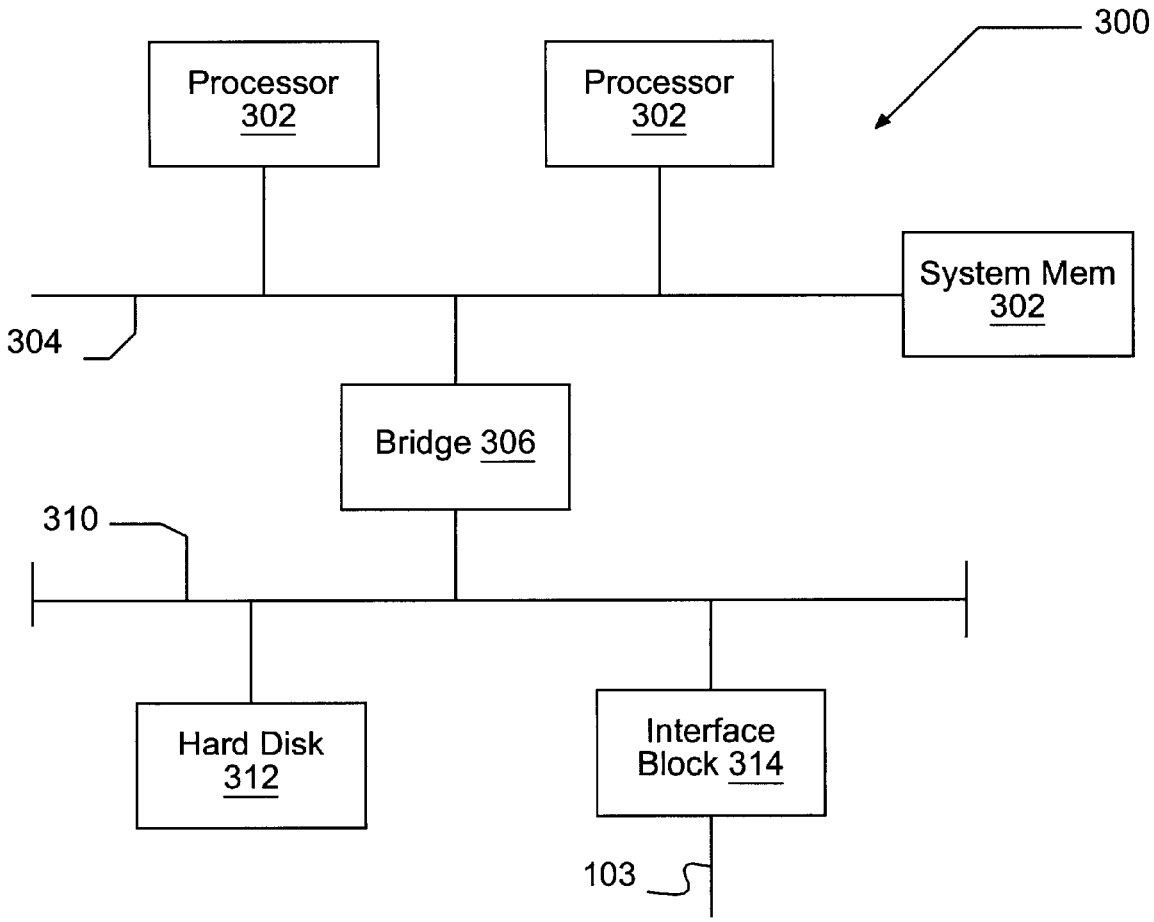
FIG. 3 is a block diagram of a data processing system suitable for use in one embodiment of the present invention.

As indicted previously, electronic device 102 may comprise a laptop data processing system. A block diagram of one such data processing system 300 is depicted in FIG. 3. In the depicted embodiment, data processing system 300 includes at least one processor 302 connected to a system memory 304 via a system bus 306. Processor 302 may be one of a variety of microprocessor including as examples, PowerPC® processors from IBM Corporation and x86 compatible processors such processors available from Intel Corporation, Advanced Micro Devices, and others. The system bus 306 is connected to one or more peripheral busses 308 (only one of which is depicted) via a bus bridge 310. Peripheral bus 308 may be designed in accordance with any of a variety of industry standard I/O bus architectures including, as an example, the peripheral components interface (PCI) bus architecture as disclosed in the PCI Local Bus Specification Rev. 2.2 and PCI-X 1.0, both available from the PCI Special Interest Group, Hillsboro, and incorporated by reference herein. Data processing system 300, via peripheral bus 302 is suitable for connecting one or more peripheral devices including input devices such as keyboards and pointing devices, output devices including printers and display screens, storage devices such as the hard drive 312 connected to system 300. While data processing system 300 may incorporate one or more of such peripheral devices, it may, nevertheless, be desirable to connect system 300 to one or more externally supplied peripheral devices. If, for example, the display screen and keyboard of data processing system 300 are relatively small to accommodate the small footprint desirable in laptop data processing systems, it may be advantageous to connect data processing system 300 to a standard sized keyboard and display screen at times when the data processing system is being used in an office or home. To accommodate connections to externally supplied peripheral devices, one embodiment of data processing system 300 includes a connection interface 314 that enables suitable wires or cables 103 to connect peripheral devices to processor(s) 302 of system 300 via peripheral bus 308.

It will be apparent to those skilled in the art having the benefit of this disclosure that the present invention contemplates a lazy-susan style docking station for an electronic device such as a laptop personal computer. It is understood that the form of the invention shown and described in the detailed description and the drawings are to be taken merely as presently preferred examples. It is intended that the following claims be interpreted broadly to embrace all the variations of the preferred embodiments disclosed.

What is claimed is:

1. An assembly, comprising:

an electronic device including at least one signal carrier;

a base piece including a signal carrier suitable for being electrically connected to at least one peripheral device;

a rotating piece intermediate between the electronic device and the base piece including a rotating piece signal carrier suitable for connecting to the electronic device signal carrier, wherein the rotating piece enables rotational movement of the electronic device with respect to the base piece while maintaining electrical contact between the rotating piece signal carrier and the base piece signal carrier of;

a set of conductive axial elements, each connected between a conductive bearing and a corresponding signal carrier in the base piece;

a set of conductive bearings at an upper surface of the base piece, wherein each conductive bearing is in electrical contact with a corresponding signal carrier in the base piece; and a set of conductive axial elements, each connected between a corresponding conductive bearing and a corresponding signal carrier in the base piece.

2. The assembly of claim 1, wherein the rotating piece includes an annular conductive element at a lower surface of the rotating piece, wherein the conductive element is in contact with a corresponding conductive bearing.

3. The assembly of claim 1, wherein the base piece signal carrier is connected to the corresponding axial element through an intermediate base piece conductive element.

4. The assembly of claim 1, wherein the conductive bearing comprises a material selected from the metals including aluminum, copper, and gold.

5. The assembly of claim 1, wherein a lower surface of the rotating piece includes at least one annular tongue protrusion and wherein an upper surface of the base piece includes at least one annular groove corresponding to each of the tongue protrusions in the rotating piece, wherein the tongue protrusions of the rotating piece are seated within corresponding grooves of the base piece thereby preventing translational movement between the rotating piece and the base piece when the rotating piece is rotated with respect to the base piece.

6. The assembly of claim 1, wherein the rotating piece may be rotated 360° with respect to the base piece.

7. The assembly of claim 1, wherein the electronic device comprises a laptop data processing system including processor, memory, input means, output means, and a peripheral connection interface suitable for connecting to each of the at least one peripherals connected to the base piece.

8. A rotational docking station for a data processing system, comprising:

a base piece including at least one signal carrier suitable for receiving a signal from a peripheral device; and at least one conductive bearing at an upper surface of the base piece, wherein each conductive bearing is in electrical contact with a corresponding signal carrier of the peripheral device;

a set of conductive axial elements connected to each of the conductive bearings and wherein each axial element is connected to a corresponding signal carrier in the base piece;

a rotating piece suitable for receiving the data processing system, the rotating piece including at least one signal carrier configured to connect the signal received from the peripheral device to the data processing system, wherein the rotating piece enables rotational movement of the data processing device with respect to the base piece while maintaining electrical contact between the at least one signal carrier of the data processing system and the corresponding at least one signal carrier of the base piece.

9. The docking station of claim 8, wherein the rotating piece includes an annular conductive element at a lower surface of the rotating piece, wherein the conductive element contacts a corresponding bearing element when the rotating piece is in contact with the base piece.

10. The docking station of claim 8, wherein the base piece includes a set of conductive axial elements connected to each of the conductive bearings and wherein each axial element is connected to a corresponding signal carrier in the base piece.

11. The docking station of claim 10, wherein each base piece signal carrier is connected to its corresponding axial element through an intermediate base piece conductive element.

12. The docking station of claim 8, wherein the conductive bearing comprises a material selected from the metals including aluminum, copper, and gold.

13. The docking station of claim 8, wherein a lower surface of the rotating piece includes at least one annular tongue protrusion and wherein an upper surface of the base piece includes at least one annular groove corresponding to each of the tongue protrusions in the rotating piece, wherein the tongue protrusions of the rotating piece are seated within each of the grooves when the rotating piece is positioned over the base piece and wherein the tongue protrusion prevents translational movement between the rotating piece and the base piece when the rotating piece is rotated with respect to the base piece.

14. The docking station of claim 8, wherein the rotating piece may be rotated 360° with respect to the base piece.

15. An electromechanical interface, comprising:

an upper surface of a base piece, wherein the base piece includes at least one signal carrier;

a lower surface of a rotating piece, wherein the rotating piece includes at least one signal carrier corresponding to the at least one signal carrier in the base piece, and wherein the lower surface includes a concentric set of annular conductive elements, wherein each annular element corresponds to one of the signal carriers;

a set of rotatable conductive bearings intermediate between the rotating piece and the base piece wherein each conductive bearing contacts a corresponding annular conductive element of the rotating piece; and a set of conductive axial elements connected to each of the conductive bearings and wherein each axial element is connected to a corresponding signal carrier in the base piece.

16. The interface of claim 15, wherein the interface includes multiple conductive bearings in contact with each annular conductive element of the rotating piece.

17. The interface of claim 15, wherein the lower surface of the rotating piece includes at least one annular tongue protrusion and wherein the upper surface of the base piece includes at least one groove, wherein the at least one annular tongue is received within a corresponding groove in the base piece.

* * * * *